United States Patent [19]

Nitta et al.

[11] Patent Number: 4,915,141

[45] Date of Patent: Apr. 10, 1990

[54] AUXILIARY NOZZLE FOR AIR JET LOOM

[75] Inventors: Yoshio Nitta, Tokorozawa; Hiroshi Suzuki, Yokohama; Masayuki Muramatsu, Tokyo, all of Japan

[73] Assignee: Nissan Motor Co., Ltd., Yokohama, Japan

[21] Appl. No.: 248,074

[22] Filed: Sep. 23, 1988

[30] Foreign Application Priority Data

Sep. 25, 1987 [JP] Japan ..... 62-241892

[51] Int. Cl.[4] ..... D03D 47/30

[52] U.S. Cl. ..... 139/435.5

[58] Field of Search ..... 139/435; 226/97

[56] References Cited

U.S. PATENT DOCUMENTS 4,436,122 3/1984 Mullekom ..... 139/435
4,794,958 1/1989 Maes et al. ..... 139/435

FOREIGN PATENT DOCUMENTS 55-36735 9/1980 Japan .
57-66152 4/1982 Japan .
173143 9/1985 Japan ..... 139/435

*Primary Examiner*—Henry S. Jaudon
*Attorney, Agent, or Firm*—Foley & Lardner, Schwartz, Jeffery, Schwaab, Mack, Blumenthal & Evans

[57] ABSTRACT

An auxiliary nozzle for an air jet loom, arranged to provide assisting force to a weft yarn picked from a weft inserting nozzle. The auxiliary nozzle is formed with a nozzle opening through which auxiliary air is ejected to enhance the air stream from the weft inserting nozzle. The nozzle opening consists of two lateral opening sections which are spaced and parallel with each other, and an axial opening section connecting the two lateral opening sections with each other. Each lateral opening section extends generally perpendicular to a plane passing through the axis of the auxiliary nozzle. The axial opening section extends generally parallel with the above-mentioned plane. Thus, the nozzle opening is generally H-shaped and extends in the direction of the thickness of the nozzle body of the auxiliary nozzle, thereby stabilizing direction of the auxiliary air ejection from the auxiliary nozzle without being affected by a variation of the air pressure to be supplied to the auxiliary nozzle.

13 Claims, 5 Drawing Sheets

AUXILIARY NOZZLE FOR AIR JET LOOM

BACKGROUND OF THE INVENTION

1. Field of the Invention

This invention relates to improvements in an auxiliary nozzle for an air jet loom in which nozzle is arranged to provide assisting force to a weft yarn projected from a weft inserting nozzle and passing through an air guide channel formed in a warp shed, and more particularly to such an auxiliary nozzle configuration to stabilize the direction of the air jet ejected from the auxiliary nozzle regardless of any change of air pressure to be supplied to the auxiliary nozzle.

2. Description of the Prior Art

Air jet looms are usually provided with a plurality of auxiliary nozzles which are disposed along an air guide channel through which a weft yarn projected from a weft inserting nozzle passes to be picked into the shed of warp yarns. The auxiliary nozzles function to eject auxiliary air obliquely toward the air guide channel and to enhance the air stream passing through the air guide channel thereby providing a weft picking assistance force to the picked weft yarn. Such an auxiliary nozzle includes a nozzle body which is formed with a nozzle opening through which auxiliary air is ejected toward the air guide channel.

Concerning the shape of such a nozzle opening, a variety of shapes have been proposed, for example, as disclosed in Japanese Patent Publication No. 55-36735 and in Japanese Patent Provisional Publication No. 57-66152. The former publication shows an arrangement in which the nozzle opening consists of many small openings which are close to but separate from each other. The latter publication shows another arrangement in which the nozzle opening is a single one which extends in a linear position.

It is necessary to change air pressure supplied to the auxiliary nozzle in accordance with the kind of weft yarns. In the arrangement in the abovementioned former publication, the direction of the air jet from the auxiliary nozzle is relatively stable regardless of the change of air pressure which is supplied to the auxiliary nozzle. Since this arrangement is such that many small openings are directly formed in a side wall facing the downstream side in the weft picking direction, it is necessary to form each small opening one by one by means of drilling or electrospark machining and to regulate the diameter of each small opening at about 0.2 mm. In the case of by drilling, the diameter of a drill is as small as about 0.2 mm, and therefore it is necessry to carry out forming machining for each small opening one by one with the greatest care in order to prevent the drill from breaking and the center from coming off, thus requiring much time and effort. In case of electrospark machining, accidents may occur in which a discharge electrode unavoidably bends under heat during the opening forming operation since the diameter of the discharge electrode is smaller relative to the discharge voltage applied to the discharge electrode. Accordingly, the small opening is unavoidably curved in the axial direction of the discharge electrode. As a result, it is difficult to obtain small openings which are uniform in air ejection direction.

In the arrangement of the above-mentioned latter publication, when air pressure supplied to the auxiliary nozzle is changed with different kinds of weft yarn, the ejection direction of the auxiliary air ejected from the auxiliary nozzle is unavoidably scattered in the weft picking direction, particularly among respective auxiliary nozzles. Thus, auxiliary nozzles of the same kind cannot be effectively employed for applications where weft yarns of various kinds are picked.

SUMMARY OF THE INVENTION

It is an object of the present invention to provide an improved auxiliary nozzle for an air jet loom which nozzle is formed with a nozzle opening which is stable in its auxiliary air ejection direction even upon change of air pressure to be supplied to the auxiliary nozzle, while facilitating the formation of the nozzle opening.

The auxiliary nozzle according to the present invention is comprised of a nozzle body formed with an air passage through which auxiliary air flows. The nozzle body has a side wall defining the air passage and generally facing the downstream side in the weft picking direction. The nozzle body side wall is formed with a nozzle opening which is communicated with the air passage. The auxiliary air is ejected from the nozzle opening. The nozzle opening consists of a lateral opening section and an axial opening section. The lateral opening section extends generally perpendicular to a plane passing through the axis of the air passage. The axial opening section extends generally parallel with the plane. The axial opening section connects with the lateral opening section at its intermediate part, so that the aixal and lateral opening sections are contiguous with each other.

Accordingly, by virtue of the interaction between the lateral and axial opening sections of the nozzle opening, the ejection direction of the auxiliary air from the auxiliary nozzle can be effectively controlled both in the right-and-left direction and in the up-and-down direction. Hence, the auxiliary air ejection direction can be stabilized even upon change of air pressure to be supplied to the auxiliary nozzle, thus improving the direction of auxiliary air ejection toward the air guide or weft picking channel. Additionally, since the lateral and axial opening sections are formed contiguously to simplify the shape of the nozzle opening, formation of the nozzle openings is facilitated greatly thereby improving productivity of auxiliary nozzles.

BRIEF DESCRIPTION OF THE DRAWINGS

In the drawings, the same reference numerals designate corresponding elements and parts throughout the figures, in which.

DETAILED DESCRIPTION OF THE INVENTION

Figure 3:
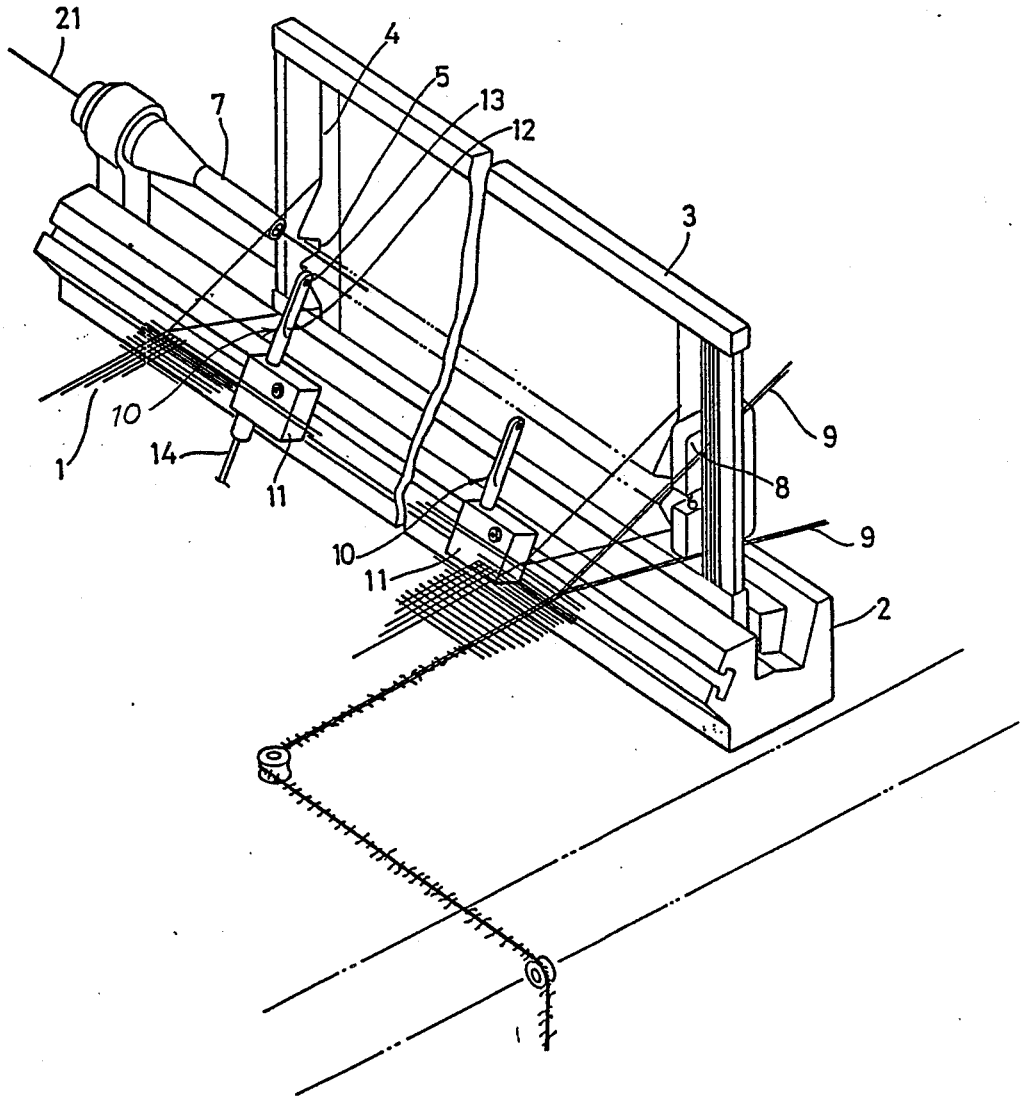
FIG. 3 is a perspective view of an air jet loom provided with the auxiliary nozzles of the first embodiment of FIGS. 1 and 2.

Referring now to FIG. 3, there is shown an essential part of an air jet loom, including a reed 3 securely mounted on a reed holder 2 which is movable forward and rearward relative to the direction of extension of warp yarns 1, timed in relation to the rotation of a main shaft (not shown) of the loom. Reed 3 has a plurality of reed blades 4 which are parallely arranged along the length of reed 3 so that a predetermined space for each warp yarn 1 is defined between the adjacent reed blades 4. Each reed blade 4 is formed at its front edge with a groove 5. A plurality of the grooves 5 of the parallely arranged reed blades 4 constitute an air guide channel 6 which extends in the direction of weft picking. A weft inserting nozzle 7 is provided upstream of the air guide channel 6, and located in such a manner that the nozzle opening at the tip end thereof is opposite to the upstream end of the air guide channel 6. The weft inserting nozzle 7 functions to eject pressurized air from its nozzle opening, in which a weft yarn 21 inserted into the weft inserting nozzle 7 is projected from the nozzle opening under influence of the pressurized air ejected from the nozzle opening. A weft sensor 8 is provided on the downstream side of the air guide channel 6 and adapted to detect the completion of weft picking of the weft yarn 21 from the weft inserting nozzle 7. Catch cords 9, 9 are provided on the downstream side of the weft sensor 8 to catch the leading end of the weft yarn 21 which has passed the weft sensor 8.

A plurality of auxiliary nozzles 10 are disposed along the air guide channel 6 and positioned at intervals of a predetermined distance. Each auxiliary nozzle 10 is according to a first embodiment of the present invention. Each auxiliary nozzle 10 is securely installed to the reed holder 2 through a holder 11. Each auxiliary nozzle 10 inclines relative to reed 3 in such a manner that the tip end thereof approaches the air guide channel 6.

Figure 1:
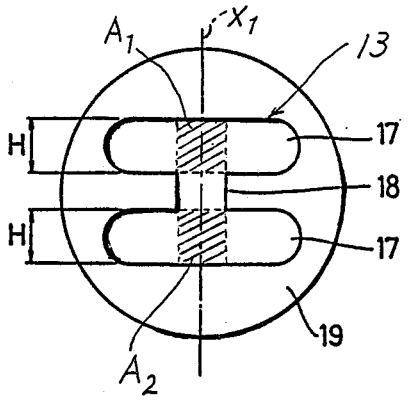
FIG. 1 is a front elevation of a chip formed with a nozzle opening, forming part of a first embodiment of an auxiliary nozzle in accordance with the present invention.
Figure 2:
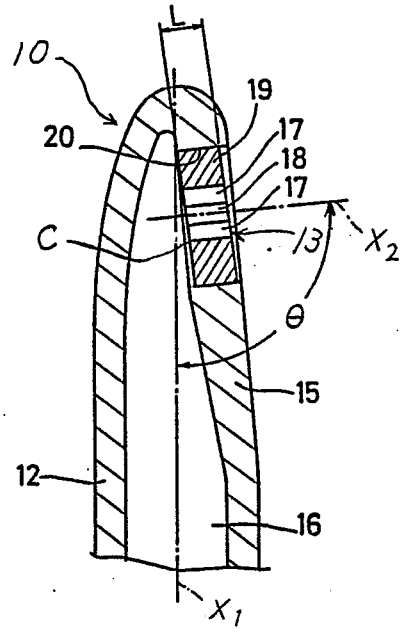
FIG. 2 is a fragmentary longitudinal vertical view of the auxiliary nozzle of the first embodiment provided with the chip of FIG. 1.

Referring to FIGS. 1 and 2, each auxiliary nozzle 10 includes a nozzle body 12 generally in the shape of a cylinder closed at its tip end. Each auxiliary nozzle 10 is connected through an air supply pipe 14 to a pressurized air source (not shown). Each auxiliary nozzle 10 is formed with a nozzle opening 13 and arranged to eject auxiliary air from the nozzle opening 13 obliquely toward the air guide channel 6 in order to assist weft picking of the weft yarn through the air guide channel 6, in which the auxiliary air enhances the air stream ejected from the weft inserting nozzle 7.

In this embodiment, each auxiliary nozzle 10 is flattened at its upper part to form a flat side wall 15 facing the downstream side of the air guide channel 6. As shown in FIG. 2, the auxiliary nozzle 10 is formed inside thereof with an axially extending air passage 16 through which auxiliary air flows under pressure. The flat side wall 15 is formed with an annular or cylindrical through-hole 20. A cylindrical chip 19 made of metal or ceramic is fitted in the through-hole 20 and securely fixed in position, for example, by means of adhesion. As best shown in FIG. 1, the nozzle opening 13 is formed in the chip 19 and consists of two lateral elongated opening sections 17, 17 which are parallel with each other and extend horizontally or perpendicular to an imaginary plane passing through the axis $X_1$ of the air passage 16. The two lateral opening sections 17, 17 are connected at their intermediate part with each other by an axial elongated opening section 18 forming part of the nozzle opening 13 so that the two lateral opening sections 17, 17 and the axial opening section 18 are contiguous with each other. The axial opening section 18 extends parallel with the imaginary plane passing through the axis $X_1$. Thus, the nozzle opening 13 is generally H-shaped in cross-section and also extends in the direction of the axis of the chip 19 as clearly seen from FIG. 2 so that an axis $X_2$ of the nozzle opening 13 is parallel with the axis of the cylindrical tip 26. The chip 19 is fixedly fitted in the through-hole 20 in such a manner that the surface thereof on the side of the air passage 16 is not projected from the inner surface of the flat wall 15 of the nozzle body 12.

In this embodiment, the surface of the chip 19 on the air passage (16) side is slightly depressed from the inner surface of the flat wall 15. As clearly illustrated in FIG. 1 and 2, each lateral opening section 17 of the nozzle opening 13 has a width H smaller than the thickness L of the chip 19, the thickness L corresponding to the length of auxiliary air flow passage of the nozzle opening 13. The total cross-sectional area of hatched parts $A_1$, $A_2$ in the nozzle opening 13 is smaller than that of the remaining part of the nozzle opening 13. The hatched parts $A_1$, $A_2$ correspond to extension of the axial opening section 18 into the two lateral opening sections 17, 17. The nozzle opening 13 is so formed that the axis $X_2$ intersects the axis $X_1$ of the air passage 16 at an obtuse angle $\theta$. Additionally, the edge C of the chip 19 defining the periphery of the nozzle opening 13 on the air passage (16) side may be chamfered to be rounded to have a smaller radius of curvature, thereby stabilizing the direction of auxiliary air ejected from the nozzle opening 13.

The manner of operation of the thus arranged auxiliary nozzle in the air jet loom will be discussed hereinafter.

As shown in FIG. 3, a plurality of the auxiliary nozzles 10 are disposed along the air guide channel 6. When pressurized air is supplied to the auxiliary nozzles 10 from the pressurized air source (not shown), auxiliary air is ejected from the nozzle opening 13 of each auxiliary nozzle 10 obliquely upwardly and toward the downstream side in the air guide channel 6. The thus ejected auxiliary air from each the auxiliary nozzles 10 enhances the air stream generated by air ejection from the weft inserting nozzle 7 thereby to providing assisting force to the weft yarn 21 projected from the weft inserting nozzle 7 under the action of the air stream from the weft inserting nozzle 7 and passing through the air guide channel 6. During such auxiliary air ejection from the nozzle opening 13 of the auxiliary nozzle 10, auxiliary air ejection in the vertical direction is restricted generally in a certain range along the lateral opening sections 17, 17, while the air stream ejected from the axial opening section 18 converges with nearby the air stream thereby to restricting the ejection direction of auxiliary air in the forward-and-rearward direction of the air guide channel 6. Accordingly, even in case where the air pressure supplied to the air passage 16 of the nozzle body 12 from the pressurized air source is changed along with a change of the kind of the weft yarn 21 to be used, ejection of auxiliary air from the auxiliary nozzle 10 is effectively prevented from changing ejection direction, thereby exhibiting a desired direction of auxiliary air. Additionally, the nozzle opening 13 is formed in chip 19 to be fitted to the auxiliary nozzle body 12, and chip 19 is formed by molding. Acordingly, formation of the nozzle opening 13 is facilitated as compared with conventional formation techniques in which a nozzle opening is directly formed in a nozzle body.

Here, effects of the first embodiment auxiliary nozzle 10 will be discussed with reference to two experiments in which the relationship among the shape of a nozzle opening, the auxiliary air ejection direction and the pressure of auxiliary air was measured.

Figure 4:
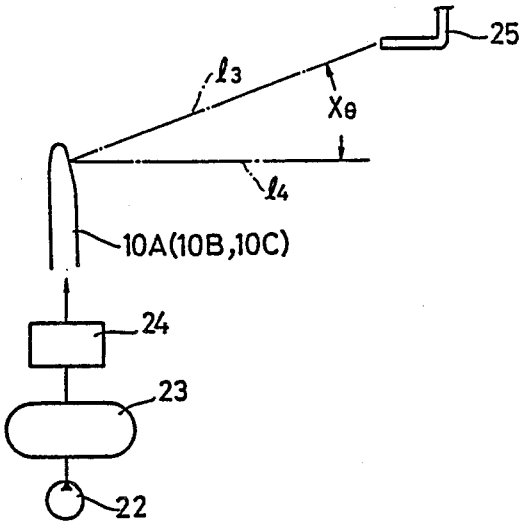
FIG. 4 is a schmeatic illustration of an experimental device used to survey a performance of the first embodiment auxiliary nozzle of FIGS. 1 to 3.
Figure 5:
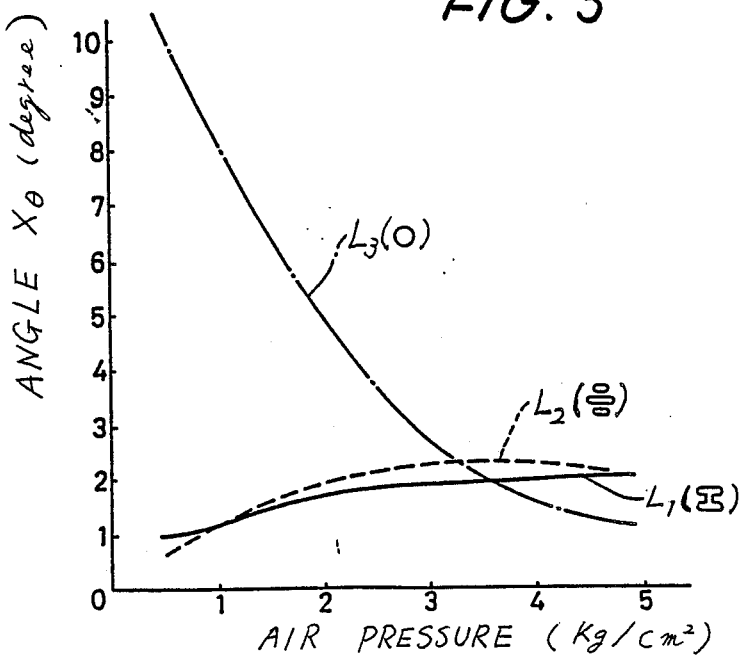
FIG. 5 is a graph showing the relationship between the elevation angle of ejected auxiliary air and the air pressure to be supplied to the auxiliary nozzle, obtained by the experimental device of FIG. 4.

(1) First Experiment (See FIGS. 4 and 5)

In this experiment, three kinds of auxiliary nozzles (first, second and third auxiliary nozzles 10A, 10B and 10C) were used. In FIG. 5, curves $L_1$, $L_2$, $L_3$ indicate experimental results of the first, second and third auxiliary nozzles 10A, 10B, 10C, respectively. The auxiliary nozzle 10A corresponded to that shown in FIGS. 1 to 3 and therefore had the generally H-shaped nozzle opening as illustrated in FIG. 5 in connection with the curve $L_1$. The second nozzle 10B was similar to that in FIG. 3, but had a nozzle opening consisting of three laterally extending opening sections which were independent from each other as illustrated in FIG. 5 in connection with the curve $L_2$. The third nozzle 10C was similar to that in FIG. 3 but had a circular (or cylindrical) nozzle opening 10C as illustrated in FIG. 5 in connection with the curve $L_3$, the nozzle opening having a diameter of 1.4 mm. In this experiment, an experimental or measuring device as shown in FIG. 4 was used in which pressurized air was supplied from a pressurized air source 22 through an air tank 23 and a regulator valve 24 to the auxiliary nozzle 10A (10B, 10C). In this experiment, the dynamic pressure of the air stream ejected from the nozzle opening of the auxiliary nozzle was measured by a Pitot tube 25 thereby determining a portion which is the highest in flow rate. This highest flow rate highest position was regarded as the center of the air stream from the nozzle opening of the auxiliary nozzle. Then, a measurement was made to determine and angle (elevation angle) $X_\theta$ of a line $l_3$ connecting the center of air stream and the center of the nozzle opening of the auxiliary nozzle relative to a horizontal base line $l_4$ which is perpendicular to the axis of the auxiliary nozzle, upon altering pressure of air to be supplied to the auxiliary nozzle. Measurement results are shown in FIG. 5 in which the elevation angle $X_\theta$ (degrees) is indicated in terms of the pressure (kg/cm$^2$) of air to be supplied to the auxiliary nozzle.

FIG. 5 demonstrates the following facts: In case of the auxiliary nozzle 10C having the circular nozzle opening, the elevation angle $X_\theta$ sharply increases with increase of the supplied air pressure. In case of the auxiliary nozzle 10B having the nozzle opening consisting of three laterally extending openings, the elevation angle $X_\theta$ takes the form of such an arcing curve as to increase with an increase of the supplied air pressure, in which it takes the maximum value of about 2.5 degrees at about 3.4 kg/cm$^2$ then gradually decreases with any further increase in supplied air pressure. In case of the auxiliary nozzle 10A corresponding to reference 10 of FIGS. 1 to 3 and having the H-shaped nozzle opening, the elevation angle $X_\theta$ gradually increases with an increase of the supplied air pressure; however, such an increase is about 1 degree. It will be understood that such a small elevation angle increase never leads to any trouble.

Figure 6:
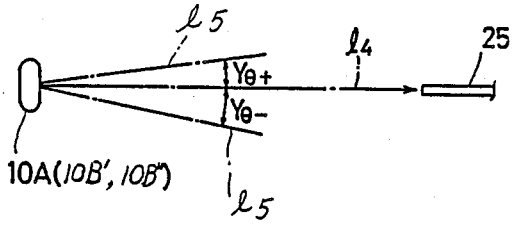
FIG. 6 is another experimental device used to survey another performance of the first embodiment auxiliary nozzle of FIGS. 1 to 3.
Figure 7:
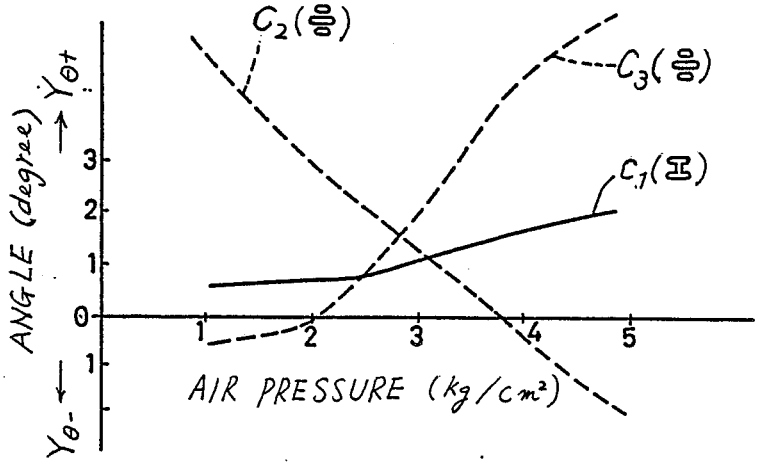
FIG. 7 is a graph showing the relationship between right or left angle of the ejected auxiliary air and the air pressure to be supplied to the auxiliary nozzle, obtained by the experimental device of FIG. 6.

(2) Second Experiment (See FIGS. 6 and 7)

In this experiment, the above-mentioned auxiliary nozzle 10A and two auxiliary nozzles 10B', 10B'' were used. In FIG. 7, the auxiliary nozzles 10B', 10B'' corresponded to the above-mentioned auxiliary nozzle 10B and therefore had the nozzle opening consisting of the three laterally extending opening sections as illustrated in FIG. 7 in connection with curves $C_2$ and $C_3$. The curves $C_1$, $C_2$, and $C_3$ indicate experimental results of the auxiliary nozzles 10A, 10B', 10B'', respectively. An experimental or measuring device used in this experiment is shown in FIG. 6, by which a line $l_5$ connecting the center of the air stream from the auxiliary nozzle and the center of the nozzle opening of the auxiliary nozzle was determined on a horizontal plane passing through the horizontal base line $l_4$ (the same as in FIG. 4). The center of the air stream was determined by measuring the flow rate highest portion of the air stream in the same manner as in the above-discussed first experiment. Then, right or left side angle $Y_{\theta+}$. $Y_{\theta-}$ of the line $l_5$ relative to the horizontal base line $l_4$ was measured on the above-mentioned horizontal plane upon altering the air pressure to be supplied to the auxiliary nozzle, thus giving the experimental results in FIG. 7 in which the angles $Y_{\theta+}$, $Y_{\theta-}$ (degrees) are indicated in terms of air pressure (kg/cm$^2$) supplied to the auxiliary nozzle.

FIG. 7 demonstrates the following facts: In the both cases of the auxiliary nozzles 10B', 10B'' having the nozzle opening consisting of three laterally extending opening sections, the angles $Y_{\theta+}$, $Y_{\theta-}$ sharply change with an increase of the supplied air pressure while the changing characteristics thereof is generally inverse. In the case of the auxiliary nozzle corresponding to that of FIGS. 1 to 3 and having the generally H-shaped nozzle opening, the angle $Y_{\theta+}$ gradually increases with an increase of the supplied air pressure; however such an increase is about 1 degree which will be understood to never lead to trouble in weft picking. Concerning the above fact that the similar auxiliary nozzles 10B', 10B'' exhibited the inverse angle changing characteristics, a detail survey was made after the above-discussed experiment and revealed that the auxiliary nozzle 10B' (whose angle $Y_{\theta+}$ decreased with the increased air pressure) was provided with a "burr" at a part of the periphery of the nozzle opening on the inner surface on the side of the air passage (16).

Next, consideration of the operation and effect of the auxiliary nozzle 10 will be made with reference to the above-discussed two experiments.

Concerning the elevation angle $X_\theta$ in FIGS. 4 and 5, it is judged that when auxiliary air advancing through the air passage 16 of the nozzle body 12 changes its advancing direction generally at right angles to be ejected from the nozzle opening 13, the velocity component of the auxiliary air in the air passage 13 is cancelled within the lateral opening sections 17 because the width H (in the direction of the axis $X_1$) of the lateral opening section 17 is smaller. For reference in this connection, by a further experiment (whose results are not shown) in which the width H of each of the two lateral opening sections 17 was altered, it was confirmed that the rate of change of the elevation angle $X_\theta$ relative to change of the air pressure supplied to the auxiliary nozzle 10 was less in the cases where the width H of the lateral opening sections 17 was less. Concerning the angle $Y_{\theta+}$, $Y_{\theta-}$ in FIGS. 6 and 7, the following judgement is made: The air stream at the cross sections (hatched parts in FIG. 1) between the lateral opening sections 17 and the vertical opening section 18 is higher in flow velocity than that at other sections of the nozzle opening 13, since the cross sections have less contact area with the wall surface defining the nozzle opening 13. As a result, the air stream in the crossing sections converges with air stream at other sections of the nozzle openings.

Figure 8:
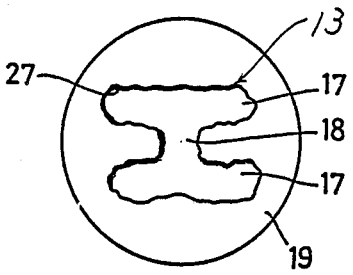
FIGS. 8, 9, 10 and 11 are front elevations similar to FIG. 1 but showing second, third, foruth and fifth embodiments, respectively, of the auxiliary nozzle in accordance with the present invention.

FIG. 8 illustrates an esential part of a second embodiment of the auxiliary nozzle 10 according to the present invention, which is similar to the first embodiment of FIGS. 1 to 3, with the exception that a plurality of small projections 27 are formed at the inner peripheral surface of the nozzle opening 13. The small projections 27 extend in the direction of the axis $X_2$ of the nozzle opening 13. With this arrangement, an air stream passing through the nozzle opening 13 is guided along the length of the projections 27, thereby further stabilizing the direction of air ejection from the auxiliary nozzle 10. The projections 27 are formed by drawing out the chip 19 having the nozzle opening 13 made of ceramics, from a die before baking.

Figure 9:
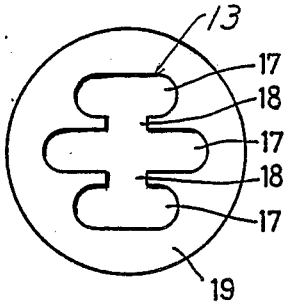

FIG. 9 illustrates an essential part of a third embodiment of the auxiliary nozzle 10 according to the present invention, which is similar to the first embodiment. In this embodiment, the nozzle opening 13 consists of three lateral opening sections 17, 17, 17 and two axial opening sections 18, 18. Each lateral opening section 17 extends perpendicular to the imaginary plane passing through the axis $X_1$ of air passage 16 of the auxiliary nozzle 10. Each axial opening section 18 extends parallel with the imaginary plane passing through the axis $X_1$. The axial opening sections 18 connect the adjacent lateral openings 17 at their intermediate part.

Figure 10:
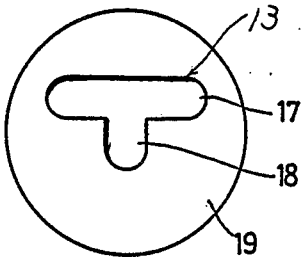

FIG. 10 illustrates an essential part of a fourth embodiment of the auxiliary nozzle in accordance with the present invention, which is similar to the first embodiment. In this embodiment, the nozzle opening 13 consists of a lateral opening section 17 and a axial opening section 18. The lateral opening section 17 extends perpendicular to the imaginary plane passing through the axis $X_1$ of the air passage 16 of the auxiliary nozzle 10. The axial opening section 18 extends parallel with the imaginary plane passing through the axis $X_1$. The axial opening section 18 is connected with the lateral opening section 17 at the intermediate part.

Figure 11:
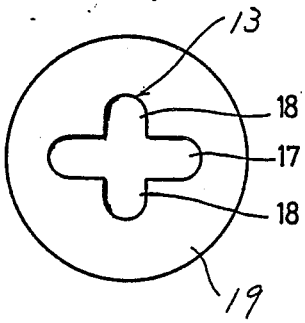

FIG. 11 illustrates an essential part of a fifth embodiment of the auxiliary nozzle 10 in accordance with the present invention, which is similar to the first embodiment of FIGS. 1 to 3. In this embodiment, the nozzle opening 13 consists of a lateral opening section 17 and two axial opening sections 18, 18. The lateral opening section 17 extends perpendicular to the imaginary plane passing through the axis $X_1$ of the air passage of the auxiliary nozzle 10. Each axial opening section 18 extends parallel with the imaginary plane passing through the axis $X_1$. The two axial opening sections 18, 18 are connected with the lateral opening section 17 at the intermediate part and located opposite to each other with respect to the lateral opening section 17.

Figure 12:
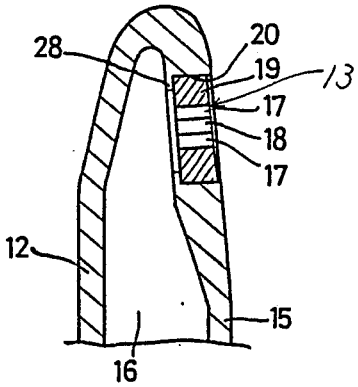
FIG. 12 is a fragmetary longitudinal view of a sixth embodiment of the auxiliary nozzle in accordance with the present invention.

FIG. 12 illustrates an essential part of a sixth embodiment of the auxiliary nozzle 10 in accordance with the present invention which is similar to the first embodiment of FIGS. 1 to 3. In this embodiment, an annular projection 28 for location of the chip 19 is integrally formed at the inner peripheral surface of the cylindrical through-hole 20 of the flat side wall 15 of the auxiliary nozzle 10, on the side of the air passage 16. More specifically, the annular projection 28 extends radially inwardly from the inner peripheral surface of the through-hole 20 and is located such that the inside surface is flush with the inner surface of the nozzle body side wall 15 defining the air passage 16. With this arrangement, the chip 19 can be suitably located in the through-hole 20 upon being brought into contact with the annular projection 28 when fitted into the through-hole 20, thereby improving assembly efficiency of the auxiliary nozzle 10.

While a single nozzle opening 13 has been shown and described as being formed in the chip 19 of each auxiliary nozzle 10, it will be understood that a variety of nozzle openings 13 as shown in FIGS. 1 and 8 to 11 may be formed in combination in the chip 19, in which one or a plurality of the various nozzle openings 13 may be located side by side or up and down.

Although the nozzle opening 13 has been shown and described as being formed in the chip 19, it will be understood that the nozzle opening 13 may be directly formed in the flat side wall 15 of the auxiliary nozzle 10. In this connection, even in the case where the various nozzle openings 13 are used in combination, such plural nozzle openings 13 may be directly formed in the flat side wall 15 of the auxiliary nozzle 10.

It will be appreciated that the widths H (in FIG. 1) of the lateral opening sections 17 of each nozzle opening 13 in the various embodiments may be different from each other, in which the width H is smaller in dimension than the length L (in FIG. 2) of the nozzle opening 13.

While the air guide channel 6 (in FIG. 3) has been shown and described as being formed by the grooves 5 of the reed blades 4, it will be understood that the air guide channel 6 may be formed by a plurality of air guide members (not shown and known per se) which are formed separate from the reed blades and located along the weft picking direction at intervals of a predetermined distance. In this case, auxiliary nozzles 10 may be assembled with some air guide members among many air guide members.

What is claimed is:

1. An auxiliary nozzle for an air jet loom, comprising:

a nozzle body formed with an air passage through which auxiliary air flows, said nozzle body having a side wall defining the air passage; and means defining a nozzle opening formed in said nozzle body and communicated with said air passage, the auxiliary air being ejected through said nozzle opening, said nozzle opening extending in the direction of the thickness of said nozzle body side wall and having the same cross-sectional shape in planes perpendicular to the direction of thickness of said nozzle body side wall, said nozzle opening defining means including means defining a first opening section forming part of said nozzle opening, and means defining a second opening section forming part of said nozzle opening, said first and second openings being generally perpendicular to each other, said second opening section connecting with said first opening section at its intermediate part so that said first and second opening sections are contiguous with each other, with the width of said first opening section being smaller in dimension than the length of said nozzle opening in the direction of the thickness of said nozzle body side wall.

2. An auxiliary nozzle for an air jet loom, comprising:

a nozzle body formed with an air passage through which auxiliary air flows, said nozzle body having a side wall defining the air passage and generally facing a downstream side in a weft picking direction; and means defining a nozzle opening formed in said nozzle body side wall and communicated with said air passage, the auxiliary air being ejected through said nozzle opening, said nozzle opening extending in the direction of the thickness of said nozzle body side wall and having the same cross-sectional shape in planes perpendicular to the direction of the thickness of said nozzle body side wall, said nozzle opening defining means including means defining a first lateral opening section forming part of said nozzle opening and extending generally perpendicular to a plane passing through the axis of the air passage of said nozzle body, and means defining a first axial opening section forming part of said nozzle opening and extending generally parallel with said plane, said first axial opening section connecting with said first lateral opening section at its intermediate part so that said first axial and lateral opening sections are contiguous with each other, with the width of said lateral opening section being smaller in dimension than the length of said nozzle opening in the direction of the thickness of said nozzle body side wall.

3. An auxiliary nozzle as claimed in claim 2, wherein said nozzle opening defining means includes a plurality of small projections each of which is formed on a surface defining said nozzle opening and extends in the direction of the axis of said nozzle opening.

4. An auxiliary nozzle as claimed in claim 2, wherein peripheral edge defining said nozzle opening at a surface on the side of said nozzle body air passage is chamfered to be rounded so as to have a smaller radius of curvature.

5. An auxiliary nozzle as claimed in claim 2, wherein a first total cross-sectional area of the extension of said axial opening section within said lateral opening section is smaller than a second total cross-sectional area of said nozzle opening other than said first total cross-sectional area.

6. An auxiliary nozzle as claimed in claim 2, wherein an axis of said nozzle opening and the axis of said nozzle body air passage forms an obtuse angle therebetween.

7. An auxiliary nozzle as claimed in claim 2, wherein said nozzle opening defining means includes means for defining a second lateral opening which is parallel with said first lateral opening and connects at its intermediate part with said first axial opening section so that said nozzle opening is generally H-shaped in cross-section.

8. An auxiliary nozzle as claimed in claim 7, wherein said nozzle opening defining means includes means defining a third lateral opening section parallel with said second lateral opening section, means defining a second axial opening section in alignment with said first axial opening section, said second axial opening section connecting said second and third lateral opening sections at their intermediate part.

9. An auxiliary nozzle as claimed in claim 2, wherein said nozzle opening defining means includes means defining a second axial opening section which is in alignment with said first axial opening section, said second axial opening section being connected with said first lateral opening section and located opposite to said first axial opening section with respect to said first lateral opening section.

10. An auxiliary nozzle as claimed in claim 2, wherein said nozzle body is formed in said side wall with a through-hole, wherein said nozzle opening defining means includes a chip in which said nozzle opening is formed, said chip being fixedly fitted in said nozzle body through-hole.

11. An auxiliary nozzle as claimed in claim 10, wherein said tip is made of ceramics.

12. An auxiliary nozzle as claimed in claim 10, further comprising a projection formed on the peripheral surface of said nozzle body through-hole to be in contact with said chip.

13. An air jet loom comprising:

a weft inserting nozzle for projecting a weft yarn therefrom under influence of an air jet ejected therefrom, the air jet forming an air stream flowing in the weft picking direction;

means defining an air guide channel through the air stream flow so that the weft yarn is carried therethrough;

a plurality of auxiliary nozzles disposed along said air guide channel to eject auxiliary air toward said air guide channel so as to enhance the air stream in said air guide channel, each auxiliary nozzle including a nozzle body formed with an air passage through which the auxiliary air flows, said nozzle body having a side wall defining the air passage and generally facing a downstream side in the weft picking direction, and means defining the nozzle opening formed in said nozzle body side wall and communicated with said air passage, the auxiliary air being ejected through said nozzle opening, said nozzle opening extending in the direction of the thickness of said nozzle body side wall and having the same cross-sectional shape in planes perpendicular to the direction of the thickness of said nozzle body side wall, said nozzle opening defining means including means defining a lateral opening section forming part of said nozzle opening and extending generally perpendicular to a plane passing axis of said nozzle body air passage, and means defining an axial opening section forming part of said nozzle opening and extending generally parallel with said plane, said axial opening section connecting with said lateral opening section at its intermediate part so that said axial and lateral opening sections are contiguous with each other, with the width of said lateral opening section being smaller in dimension than the length of said nozzle opening in the direction of the thickness of said nozzle body side wall.

* * * * *